US006854807B2

(12) United States Patent
D'Alessandro

(10) Patent No.: US 6,854,807 B2
(45) Date of Patent: Feb. 15, 2005

(54) LOUNGE CHAIR WITH CLOSEABLE FACE OPENING

(75) Inventor: David D'Alessandro, Lawrenceville, NJ (US)

(73) Assignee: Deltess Corporation, Lawrenceville, NJ (US)

( * ) Notice: Subject to any disclaimer, the term of this patent is extended or adjusted under 35 U.S.C. 154(b) by 0 days.

(21) Appl. No.: 10/607,787

(22) Filed: Jun. 27, 2003

(65) Prior Publication Data

US 2004/0262970 A1 Dec. 30, 2004

(51) Int. Cl.[7] ..... A47C 1/00
(52) U.S. Cl. ..... 297/900; 5/111; 5/725
(58) Field of Search ..... 297/900, 354.13; 5/725, 638, 112, 111

(56) References Cited

U.S. PATENT DOCUMENTS

D352,635 S * 11/1994 Yoder ..... D6/611
5,466,039 A * 11/1995 Umbrianna ..... 297/116
D381,824 S * 8/1997 Day et al. ..... D6/361
5,829,080 A * 11/1998 Robillard et al. ..... 5/638
5,950,259 A * 9/1999 Boggs ..... 5/111
6,012,184 A * 1/2000 Childers ..... 5/416
6,068,342 A * 5/2000 Mariani et al. ..... 297/188.01
6,109,685 A * 8/2000 Lindsey et al. ..... 297/40

* cited by examiner

*Primary Examiner*—Peter M. Cuomo
*Assistant Examiner*—Stephen Vu
(74) *Attorney, Agent, or Firm*—Stuart M. Goldstein

(57) ABSTRACT

A recreational lounge chair which can be used for upright sitting and also for lying prone on one's back or stomach has a seat section and a back section which is pivotally attached. This allows the chair to be converted between an upright chair and a lounge chair for reclining. A footrest section is attached to the seat section and can be pivotable down for upright seating or up for elevating the feet or for reclining in a prone position. The back section includes a through opening configured for the placement of the face of a user lying prone on his or her stomach, when the chair is so configured. The opening is bordered by cushioned pads, for the user's comfort. In this configuration, the user, lying face down and literally looking through the chair, can read a book, as there are cutout openings in the back section of the chair which allows the user to extend his or her arms under the chair, to hold the book. When the user wishes to lie on his or her stomach or sit-up in an upright position, a flap on the undersurface of the back section of the chair is extended and the pads are pivoted over to close the through opening.

19 Claims, 3 Drawing Sheets

LOUNGE CHAIR WITH CLOSEABLE FACE OPENING

BACKGROUND OF THE INVENTION

There are a wide variety of lounge type chairs, especially those used for outdoor recreation, e.g. at the beach, poolside, picnics, etc., which are designed to allow the user to recline on his or her stomach. However, when lying in this position on such commonly used chairs, one needs to rest his or her head on one side of the face or the other. This is not only uncomfortable and could result in a stiff neck or other problems, but, when lying in the sun, can also cause burning on one side of the face. It further is virtually impossible to read a book or other reading material in this position and even placement of ones arms can be awkward.

SUMMARY OF THE INVENTION

It is thus the object of the present invention to overcome the limitations and disadvantages of prior recreational lounge chairs.

It is a general object of the present invention to provide a recreational lounge chair which can be used comfortably both when one is sitting or lying on his or her stomach.

It is an object of the present invention to provide a recreational lounge chair which readily and easily transforms to positions which allow both comfortable sitting and lying on one's back or stomach.

It is another object of the present invention to provide a recreational lounge chair which enables the user to easily hold and comfortably read a book, magazine or the like, while lying prone on his or her stomach.

It is still another object of the present invention to provide a recreational lounge chair which has an expanded back section for comfortable placement of arms on the chair when one is lying prone on the stomach.

It is a further object of the present invention to provide a recreational lounge chair which protects the face of the user from the effects of the sun and from neck injury, while lying prone on the stomach.

It is still another object of the present invention to provide a recreational lounge chair which readily converts from an upright chair to a lounge chair which allows lying on the back or stomach.

It is another object of the present invention to provide a recreational lounge chair which has a face opening in its back section for use when one is lying on his or her stomach and which can be covered to allow sitting or lying on one's back.

These and other objects are accomplished by the present invention, a recreational lounge chair which can be used for upright sitting and also for lying prone on one's back or stomach. The chair has a seat section and a back section which is pivotally attached. This allows the chair to be converted between an upright chair and a lounge chair for reclining. A footrest section is attached to the seat section and can be pivotable down for upright seating or up for elevating the feet or for reclining in a prone position. The back section includes a through opening configured for the placement of the face of a user lying prone on his or her stomach, when the chair is so configured. The opening is bordered by cushioned pads, for the user's comfort. In this configuration, the user, lying face down and literally looking through the chair, can read a book, as there are cutout openings in the back section of the chair which allows the user to extend his or her arms under the chair, to hold the book. When the user wishes to lie on his or her stomach or sit-up in an upright position, a flap on the undersurface of the back section of the chair is extended and the pads are pivoted over to close the through opening.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
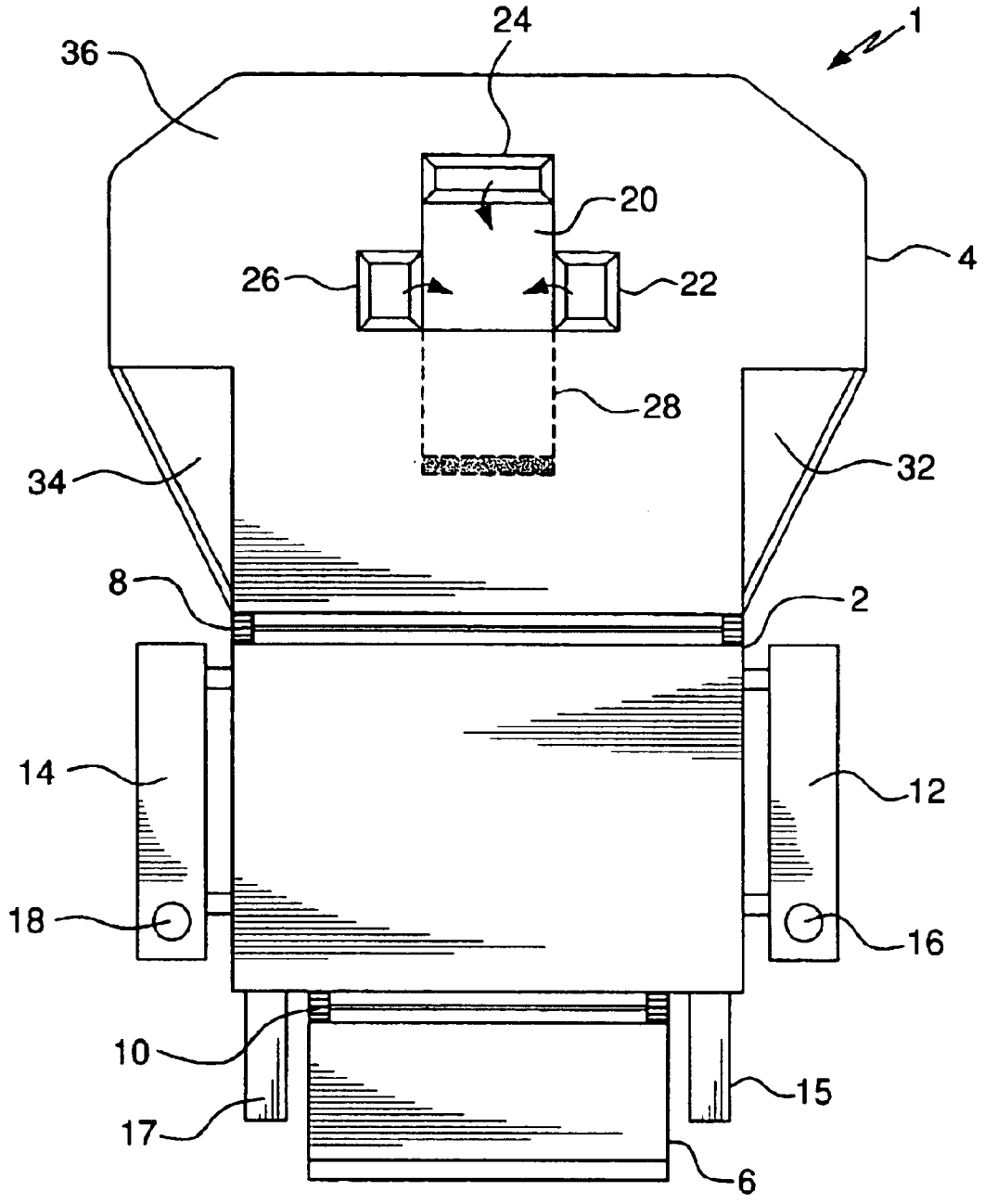
FIG. 1 is a top view of the chair of the present invention with its back and footrest sections fully extended.

Lounge chair 1 of the present invention comprises seat section 2, back section 4 and footrest section 6. Sections 2, 4 and 6 pivotably connected at 8 and 10 by known means which permit the sections to be locked in various angles in relation to each other. For instance sections 2, 4, and 6 can be positioned at right angles to each other, for upright seating. Footrest section 6 can be extended up and positioned at an approximate 180° angle with seat section 2 to elevate the sitting user's feet. When all sections are positioned at an approximate 180° angle with each other, the sections are substantially in the same transverse plane and chair 1 is in the reclining position to allow the user to lie prone on the chair 1.

Chair 1 has legs 15 and 17 and is also provided with arm rests 12 and 14 secured to seat section 2. Arm rests may have cup holders 16 and 18.

Figure 2:
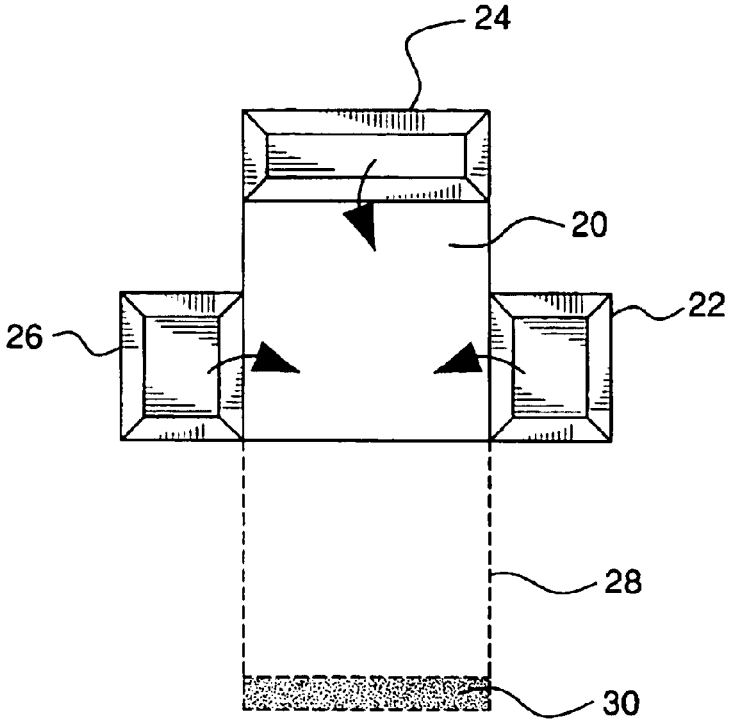
FIG. 2 is a detailed top view of the chair opening.
Figure 3:
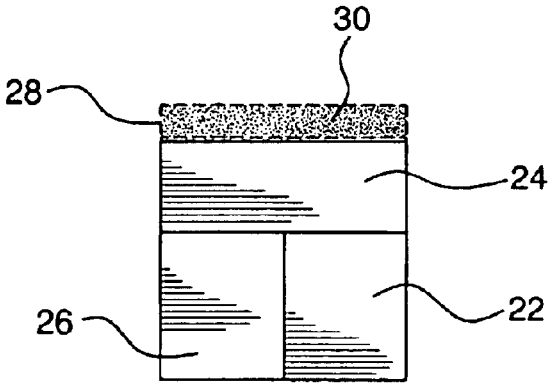
FIG. 3 is a detailed top view of the chair opening covered up.

Back section 4 comprises through opening 20. Sides of opening 20 are bordered by cushioned pads 22, 24, and 26. Each of these pads are attached at a side of opening 20 by a sewn or like connection which allows the pads to pivot outward and rest on the upper surface of back section 4, thereby uncovering the opening (FIGS. 1 and 2). Such a connection also allows the pads to pivot inward to cover the opening (FIG. 3).

Flap 28 is attached to the undersurface of back section 4 adjacent to opening 20 by a similar sewn or like connection which allows the flap to pivot away from the opening or over the opening, to cover it. Flap 28 has Velco™ or similar connection 30 which secures the flap to the underside of back section 4 in both positions, via corresponding Velco™ connections secured on the back section. Pads 22, 24, and 26 may also have Velco™ type connections for attachment to the top surface of back section 4, to maintain the pads in their outwardly extending positions, as shown in FIGS. 1 and 2.

When the user wishes to fully recline on chair 1 on his or her stomach, opening 20 is uncovered, i.e. pads 22, 24, and 26 and flap 28 are positioned as shown in FIGS. 1 and 2. The user lies stretched out in a prone position on chair 1 and places his or her head face-down into opening 20. The head is cushioned by pads 22, 24, and 26, thus allowing the user to lie down in comfort.

Back section 4 also comprises cut-out openings 32 and 34, to allow one who is lying prone and face-down on chair 1, to extend his or her arms, through the openings. By this design, the user can hang the arms down or hold a book or other reading material underneath back section 4 and read it, while lying prone on the stomach, with his or her face placed within opening 20.

As seen in FIG. 1, back section 4 is also configured with expanded upper area 36. This allows the prone, face-down user additional room to extend his or her arms above the head.

When it is desired that chair 1 be used for upright sitting or lying prone on one's back, flap 28 is pivoted upward, positioned so as to cover opening 20, and secured in place on the underside of back section 4. Pads 22, 24, and 26 are then pivoted inward to cover opening 20, as shown in FIG. 3.

It should be understood that the configuration of the closure of opening 20 by pads 22, 24 and 26 and flap 28 is not to be restricted to that which is shown in the drawings. For instance, pads 22 and 26 can be extended for the full length of the sides of opening 20, to provide a different cushioning effect to the user. To cover the opening in this configuration, pads 22, 24 and 26 are pivoted down, so as to be hanging down, below and underneath back section 4. Flap 28 would then be moved up through opening 20 and extended over the opening from the top side of back section 4.

When pads 22, 24 and 26 are shaped as shown and cover the opening as depicted in FIG. 3, flap 28 can be used to cover opening 20 by moving the flap up through the opening and then extending the flap over the opening onto the top surface of back section 4.

It should also be recognized that opening 20 can be variously configured, for instance, as horseshoe, circular, or similar shape which is comfortable to fit the users' head, face down, as the face extends through the opening. The cushioning pads used for these variously shaped openings would be configured to fit the opening and similarly be positioned and extend along the sides of the opening.

Figure 4:
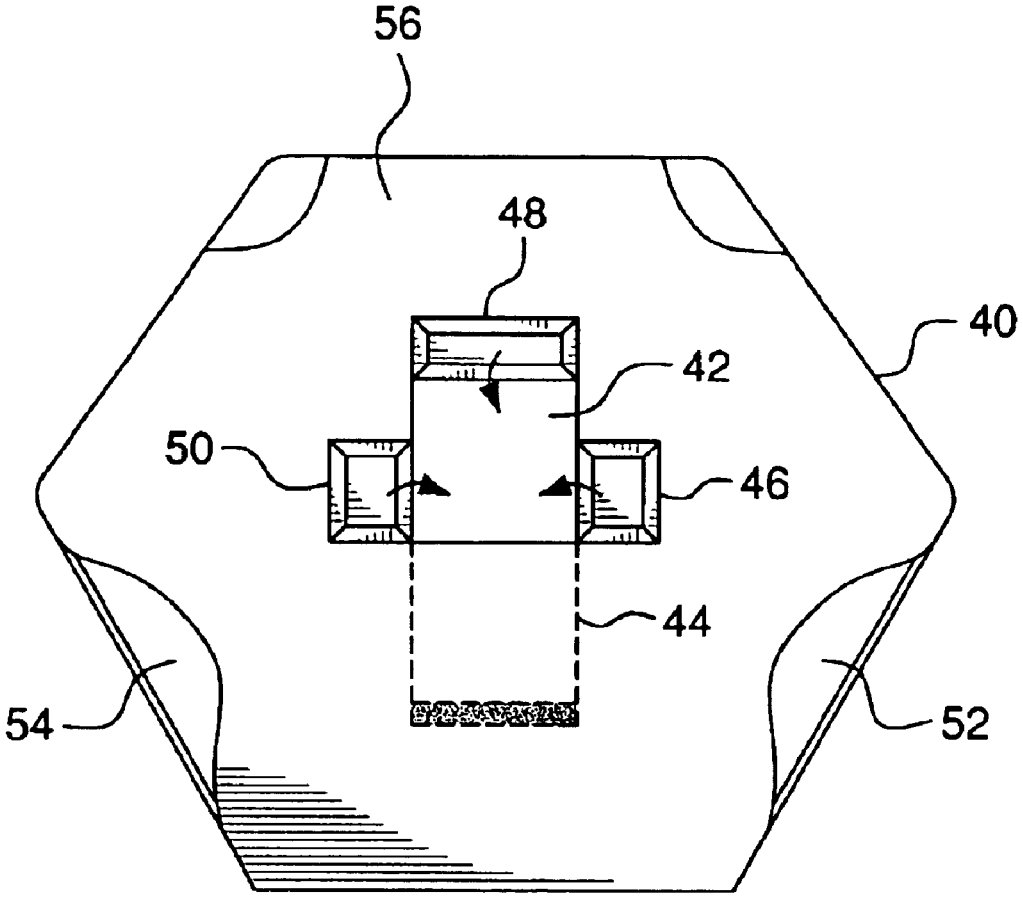
FIG. 4 is a top view of another design embodiment of the invention.

FIG. 4 shows the chair of the current invention with an alternate back section configuration. Back section 40 has opening 42, flap 44, and cushions 46, 48, and 50, arranged similarly to that which has previously been described. However, arm cut-out openings 52 and 54 and expanded upper area 56 are configured differently.

Certain novel features and components of this invention are disclosed in detail in order to make the invention clear in at least one form thereof. However, it is to be clearly understood that the invention as disclosed is not necessarily limited to the exact form and details as disclosed, since, as discussed, it is apparent that various modifications and changes may be made without departing from the spirit of the invention.

I claim:

1. A lounge chair comprising a seat section, a back section, and means connecting the seat and back sections to allow pivoting of the back section between user sitting and user reclining chair positions, said back section comprising opening means for the placement of the face of a user lying on his or her stomach while the chair is in a reclining position, closure means to cover the opening means when the chair is in a sitting position or when the user is lying on the chair on his or her back while the chair is in a reclining position, and lateral cutout means to allow insertion of the arms of the user while the chair is in the reclining position.

2. The lounge chair as in claim 1 wherein the closure means comprises a flap connected to the back section, said flap extending away from the opening means when the opening means is uncovered and extending over the opening means when the opening means is covered.

3. The lounge chair as in claim 2 further comprising pad means attached around sides of the opening means to cushion the face of the user placed in the opening means.

4. The lounge chair as in claim 3 wherein the pad means are pivotally attached around sides of and are configured to allow access to the opening means when the chair is in the reclining position.

5. The lounge chair as in claim 2 wherein the closure means further comprises pads which are pivotally attached around sides of the opening means and are configured to allow access to the opening means when the opening means is uncovered and to extend over the opening means when the opening means is covered.

6. The lounge chair as in claim 5 wherein the flap is connected to a bottom surface of the back section and covers the opening means from the bottom surface, and the pads are connected to top surfaces of the back section and cover the opening means from the top surfaces.

7. The lounge chair as in claim 1 further comprising pad means attached around sides of the opening means to cushion the face of the user placed in the opening means.

8. The lounge chair as in claim 7 wherein the pad means are pivotally attached around sides of the opening means and are configured to allow access to the opening means when the opening means is uncovered and to extend over the opening means when the opening means is covered.

9. The lounge chair as in claim 1 wherein the closure means comprises pads which are pivotally attached around sides of the opening means and are configured to allow access to the opening means when the opening means is uncovered and to extend over the opening means when the opening means is covered.

10. The lounge chair as in claim 1 comprising a foot rest section and means connecting the foot rest section and seat section to allow pivoting of the foot rest section between user sitting and user reclining positions.

11. The lounge chair as in claim 1 wherein said back section has expanded side portions to allow placement of the arms of the user.

12. A lounge chair comprising a seat section and a back section with top and bottom surfaces and means connecting the seat and back sections to allow pivoting of the back section between user sitting and user reclining chair positions, said back section comprising a through opening, a flap connected to the bottom surface of the back section, means to attach the flap to the bottom surface to cover the opening and to maintain and to attach the flap on the bottom surface to uncover the opening, pads pivotally attached around sides of the opening, said pads being configured to remain on the top surface of the back section when the opening is uncovered and pivot onto the flap when the flap covers the opening.

13. The lounge chair as in claim 12 further comprising a foot rest section and means connecting the foot rest section and seat section to allow pivoting of the foot rest section between user sitting and user reclining positions.

14. The lounge chair as in claim 12 wherein said back section has expanded side portions to allow placement of the arms of the user.

15. The lounge chair as in claim 12 wherein said back section further comprising lateral cut-out means to allow insertion of the arms of the user while the chair is in the reclining position.

16. A lounge chair comprising a seat section, a back section, and means connecting the seat and back sections to allow pivoting of the back section between user sitting and user reclining chair positions, said back section comprising opening means for the placement of the face of a user lying on his or her stomach while the chair is in a reclining position and closure means to cover the opening means when the chair is in a sitting position or when the user is lying on the chair on his or her back while the chair is in a reclining position, said closure means comprising a flap connected to the bottom surface of the back section, said flap extending away from the opening means when the opening means is uncovered and extending in addition to covering over the opening means from the bottom surface when the opening means is covered, said closure means further comprising pads which are pivotally attached to top surfaces of the back section and around sides of the opening means to allow access to the opening means when the opening means is uncovered to extend over and cover the opening means from the top surfaces when the opening means is covered.

17. The lounge chair as in claim 16 comprising a foot rest section and means connecting the foot rest section and seat section to allow pivoting of the foot rest section between user sitting and user reclining positions.

18. The lounge chair as in claim 16 wherein said back section has expanded side portions to allow placement of the arms of the user.

19. The lounge chair as in claim 16 wherein said back section further comprises lateral cut-out means to allow insertion of the arms of the user while the chair is in the reclining position.

* * * * *